US007277108B2

(12) United States Patent
Tatematsu et al.

(10) Patent No.: US 7,277,108 B2
(45) Date of Patent: Oct. 2, 2007

(54) FIXING APPARATUS

(75) Inventors: Hideki Tatematsu, Ashiya (JP); Tadafumi Shimizu, Ogori (JP); Masahiro Samei, Toyonaka (JP); Keiichi Matsuzaki, Kurume (JP); Kazunori Matsuo, Onojo (JP); Shoichi Kitagawa, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 111 days.

(21) Appl. No.: 10/543,190

(22) PCT Filed: Jan. 11, 2005

(86) PCT No.: PCT/JP2005/000192

§ 371 (c)(1),
(2), (4) Date: Jul. 22, 2005

(87) PCT Pub. No.: WO2005/071496

PCT Pub. Date: Aug. 4, 2005

(65) Prior Publication Data

US 2006/0133864 A1 Jun. 22, 2006

(30) Foreign Application Priority Data

Jan. 23, 2004 (JP) ..... 2004-016168

(51) Int. Cl.
*G03G 15/20* (2006.01)

(52) U.S. Cl. ..... 347/156; 399/323

(58) Field of Classification Search ..... 347/212, 347/155, 156; 399/320, 322, 323
See application file for complete search history.

(56) References Cited

U.S. PATENT DOCUMENTS 7,149,463 B2 * 12/2006 Fujisawa et al. ..... 399/323

FOREIGN PATENT DOCUMENTS

| | | |
|---|---|---|
| JP | 7-181826 | 7/1995 |
| JP | 9-222813 | 8/1997 |
| JP | 11-184300 | 7/1999 |
| JP | 2003-215967 | 7/2003 |

OTHER PUBLICATIONS

English language Abstract of JP 2003-215967.
English language Abstract of JP 7-181826.
English language Abstract of JP 9-222813.
English language Abstract of JP 11-184300.

* cited by examiner

*Primary Examiner*—Huan Tran
(74) *Attorney, Agent, or Firm*—Greenblum & Bernstein, P.L.C.

(57) ABSTRACT

A fixing apparatus is provided that enables a recording medium that has undergone heat-fixing to be separated smoothly from a heating medium without causing a sheet jam or image disturbance. In this apparatus, there are provided on the guide surface of a separator two step parts raised along the guide surface guide width direction. Recording paper is transported gripped by a fixing nip, is guided so as to come into contact with only the apex parts of step parts, and is separated from the surface of a fixing belt. Thus, a gap is formed between the guide surface and the heat-fixing surface of recording paper guided along the guide surface, the contact area between the heat-fixing surface of recording paper and the guide surface decreases, the heat-fixing surface of recording paper becomes less prone to adhere to the guide surface of the separator, and recording paper is smoothly separated from the fixing belt without causing a sheet jam or image disturbance.

18 Claims, 12 Drawing Sheets

FIXING APPARATUS

TECHNICAL FIELD

The present invention relates to a fixing apparatus that heat-fixes an unfixed image onto a recording medium, and more particularly to a fixing apparatus useful for employment in an image forming apparatus such as an electrophotographic or electrostatographic copier, facsimile machine, or printer.

BACKGROUND ART

A heating-type fixing apparatus is generally used in such image forming apparatuses. This heating-type fixing apparatus includes a heating medium comprising an endless belt, roller or the like, a heating section that heats this heating medium, and a pressure section that presses against the heating medium.

The heating section comprises a halogen lamp or induction heating (IH) apparatus, for example. The pressure section comprises a rubber roller, sponge roller, or the like that rotates in contact with the heating medium, and transports a recording medium such as recording paper or an OHP sheet gripped by the nip formed between itself and the heating medium.

In this heating-type fixing apparatus, toner of an unfixed image formed on the recording medium by heat from the heating medium by transporting the recording medium gripped in the nip is melted, and the unfixed image is fixed upon the recording medium by means of the adhesive force of this melted toner.

Therefore, this fixing apparatus is prone to the occurrence of a phenomenon whereby the recording medium becomes wrapped around the heating medium due to the adhesive force of toner melted by heating. This kind of phenomenon tends to occur when a solid image is formed on the front part of a recording medium being heat-fixed relative to the sheet transportation direction. Also, this phenomenon is more likely to occur when the fixing apparatus has been used and become warmed to some degree than when the fixing apparatus is powered on.

Thus, with this kind of fixing apparatus, for example, a separation lug is installed as a sheet separation section that comes into contact with the surface of the heating medium downstream of the aforementioned nip, and a recording medium that has undergone heat-fixing is forcibly separated from the heating medium by means of this separation lug (see Patent Document 1, for example).

However, a fixing apparatus using a separation lug as the above-described sheet separation section has a configuration in which the separation lug is in contact with the heating medium, and therefore has a deficiency in that marks tend to be made on the surface of the heating medium due to the direct contact of the separation lug. This deficiency is seldom a problem when the hardness of the heating medium is of a comparatively high degree, as in the case of a fixing apparatus for monochrome images, but when an elastic layer is formed on the heating medium, as in the case of a fixing apparatus for color images, this deficiency is the cause of a significant decrease in the life of the heating medium and the quality of fixed images.

On the other hand, a fixing apparatus is known in which a sheet separation guide plate is used as the above-described sheet separation section instead of a separation lug, and a recording medium that has undergone heat-fixing is separated from the heating medium by means of this sheet separation guide plate (see Patent Document 2, for example).

FIG. 1 is a schematic cross-sectional drawing showing the state at the start of separation of a recording medium (recording paper) in a fixing apparatus that uses a sheet separation guide plate (hereinafter referred to as "separator") as the above-described separation section. As shown in FIG. 1, this fixing apparatus 10 is equipped with a fixing roller 11 as the above-described heating medium, a pressure roller 12 as the above-described pressure section, sheet guide plates 13, 14, and 15 forming a transportation path of recording paper P, a separator 16, and so forth.

In FIG. 1, after an unfixed toner image T is formed on recording paper P by an image forming section (not shown), recording paper P is transported toward fixing apparatus 10. This recording paper P passes between the pair of sheet guide plates 13 and 14 located at the sheet transportation entrance of fixing apparatus 10, and, gripped by fixing nip N—the pressure location between fixing roller 11 and pressure roller 12—is transported in the direction indicated by the arrow. After recording paper P has passed through fixing nip N, the front part Pa is distanced from the surface of fixing roller 11 by the curvature of fixing roller 11.

By means of a guide surface 16*a*, separator 16 guides front part Pa of recording paper P distanced from the surface of fixing roller 11, and separates recording paper P from the surface of fixing roller 11.

Thus, in this fixing apparatus 10, front part Pa of recording paper P is first distanced from the surface of fixing roller 11 by the curvature of fixing roller 11, and then this front part Pa of recording paper P distanced from the surface of fixing roller 11 is guided and separated from fixing roller 11 by guide surface 16*a* of separator 16.

Therefore, in this fixing apparatus 10, as shown in FIG. 1, separator 16 that separates recording paper P from the surface of fixing roller 11 is installed so as not to be in contact with fixing roller 11, and consequently no marks of contact are made on fixing roller 11 as in the case of the above-described separation lug, and there is no associated decrease in the life of fixing roller 11 or the quality of fixed images.

Patent Document 1: Unexamined Japanese Patent Publication No. 2003-215967.

Patent Document 2: Unexamined Japanese Patent Publication No. HEI 07-181826.

DISCLOSURE OF INVENTION

PROBLEMS TO BE SOLVED BY THE INVENTION

However, a problem with a conventional heat-fixing type fixing apparatus that uses a sheet separation guide plate as described above is proneness to the occurrence of a sheet jam and image disturbance while a recording medium that has undergone heat-fixing is being separated and transported via the above-described sheet separation guide plate.

That is to say, with a fixing apparatus of this kind, a certain amount of time is necessary for an unfixed image (toner image) on a recording medium to set (become fixed to the recording medium) after being melted by heat from the heating medium. This time needed for a toner image to set after being melted varies subtly according to various conditions such as the speed of recording medium transportation, toner quality, the amount of toner fixed to the recording medium, the heating temperature of the heating medium, the internal temperature of the fixing apparatus, and the ambient temperature.

Therefore, in this kind of heat-fixing type fixing apparatus, setting of the toner image on the recording medium will not necessarily be completed within the period during which the recording medium travels the distance from the heating medium heat-fixing location to the upstream end of the sheet separation guide plate.

Consequently, with this kind of fixing apparatus, it may happen for example that, as shown in FIG. 2, recording paper P moves along guide surface 16*a* of separator 16 while the toner image on recording paper P has not yet set, and toner image in this half-set state adheres to or brushes guide surface 16*a* of separator 16 and a sheet jam and/or image disturbance occurs.

This kind of sheet jam and image disturbance is likely to occur when the toner image formed on the recording medium is a solid image. This is because a solid image has a larger amount of toner than an ordinary image, and therefore the melted toner takes a longer time to set.

This kind of sheet jam and image disturbance is particularly likely to occur when a solid image is formed on the rear part of the recording medium relative to the sheet transportation direction. This is because, for example, the rear part Pb of recording paper P becomes free at a the moment at which it escapes from fixing nip N between fixing roller 11 and pressure roller 12, as shown in FIG. 3. That is to say, rear part Pb of recording paper P springs up onto the guide surface of separator 16 at the instant at which it becomes free, and its entire surface comes into close contact with guide surface 16*a* of separator 16. Consequently, if a solid image has been formed on this rear part Pb of recording paper P in close contact with guide surface 16*a* of separator 16, this rear part Pb will adhere to guide surface 16*a*, likely resulting in the occurrence of a sheet jam and/or image disturbance.

This kind of sheet jam and image disturbance also tends to occur when the internal temperature of the fixing apparatus is high and the sheet separation guide plate becomes hot, as the toner image heat-fixed to the recording medium does not set readily or melts again.

It is an object of the present invention to provide a fixing apparatus that enables a recording medium that has undergone heat-fixing to be separated smoothly from the heating medium without causing a sheet jam or image disturbance.

MEANS FOR SOLVING THE PROBLEM

A fixing apparatus of the present invention has a configuration that includes a heating medium that heat-fixes an unfixed image onto a recording medium, a heating section that heats the heating medium, and a sheet separation guide plate having a guide surface that guides the heat-fixed surface of the recording medium on which an unfixed image is heat-fixed and that is transported along a predetermined sheet path in a direction of separation from the heating medium; wherein a step section that rises in the guide width direction of the guide surface is provided on the guide surface of the sheet separation guide plate.

ADVANTAGEOUS EFFECT OF THE INVENTION

The present invention enables a recording medium that has undergone heat-fixing to be separated smoothly from the heating medium without causing a sheet jam or image disturbance.

BEST MODE FOR CARRYING OUT THE INVENTION

Figure 1:
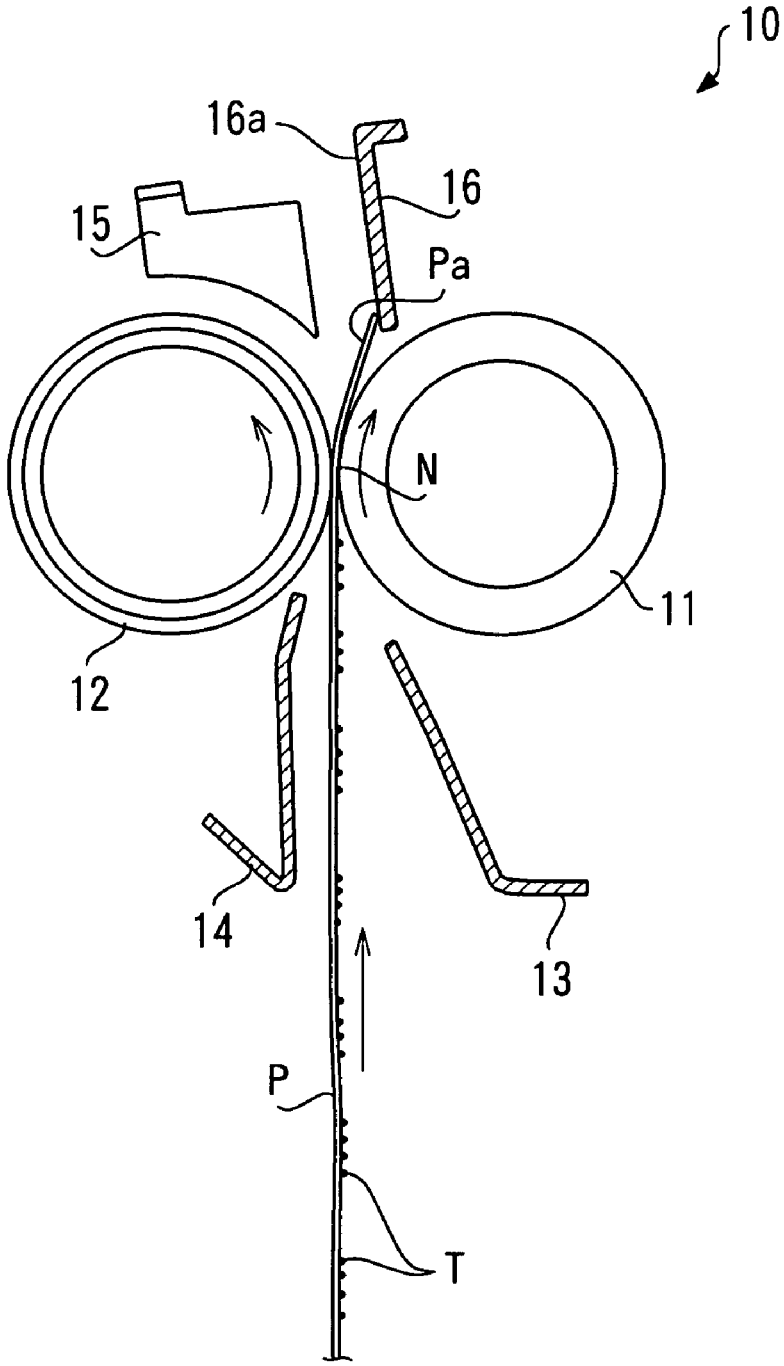
FIG. 1 PRIOR ART
FIG. 1 is a schematic cross-sectional drawing showing the state at the start of separation of a recording medium in a fixing apparatus using a conventional separator.
Figure 2:
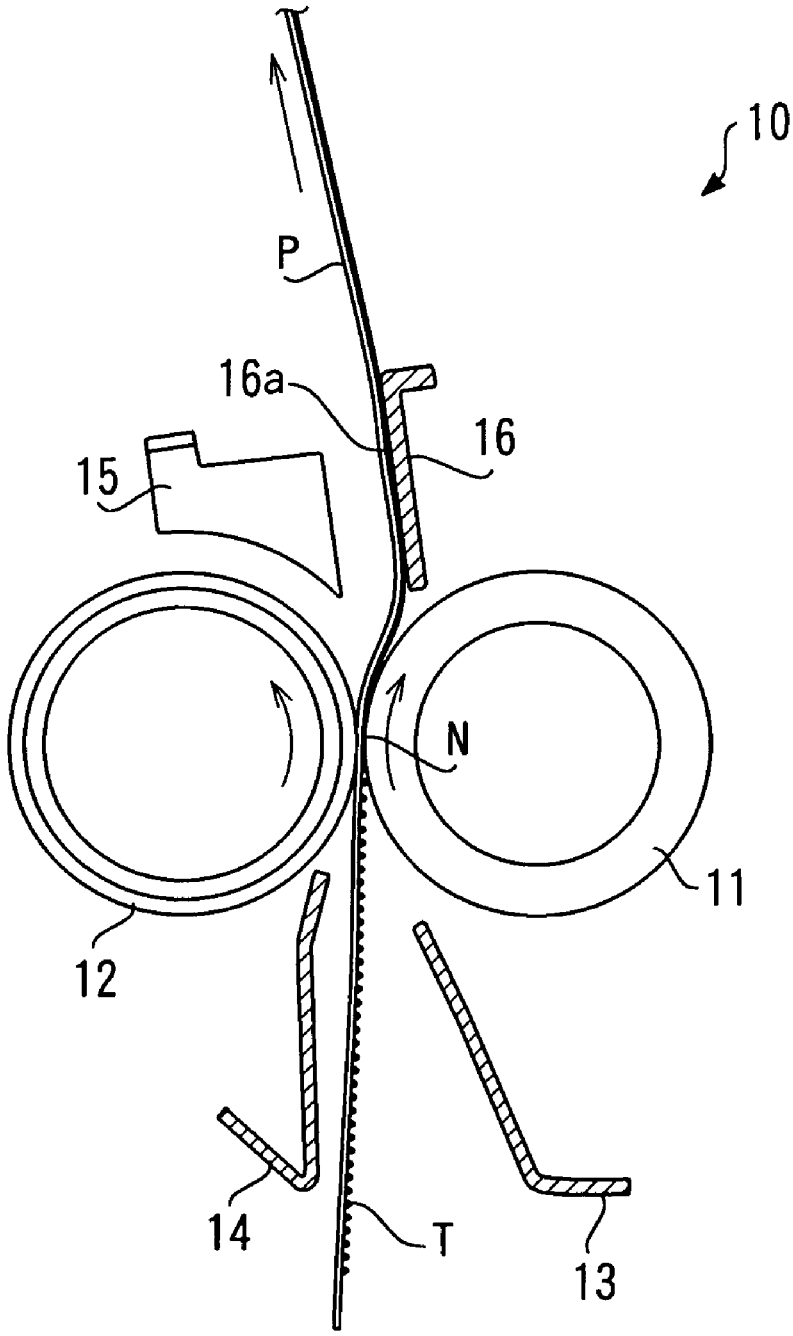
FIG. 2 PRIOR ART
FIG. 2 is a schematic cross-sectional drawing showing the state during separation of a recording medium in a fixing apparatus using a conventional separator.
Figure 3:
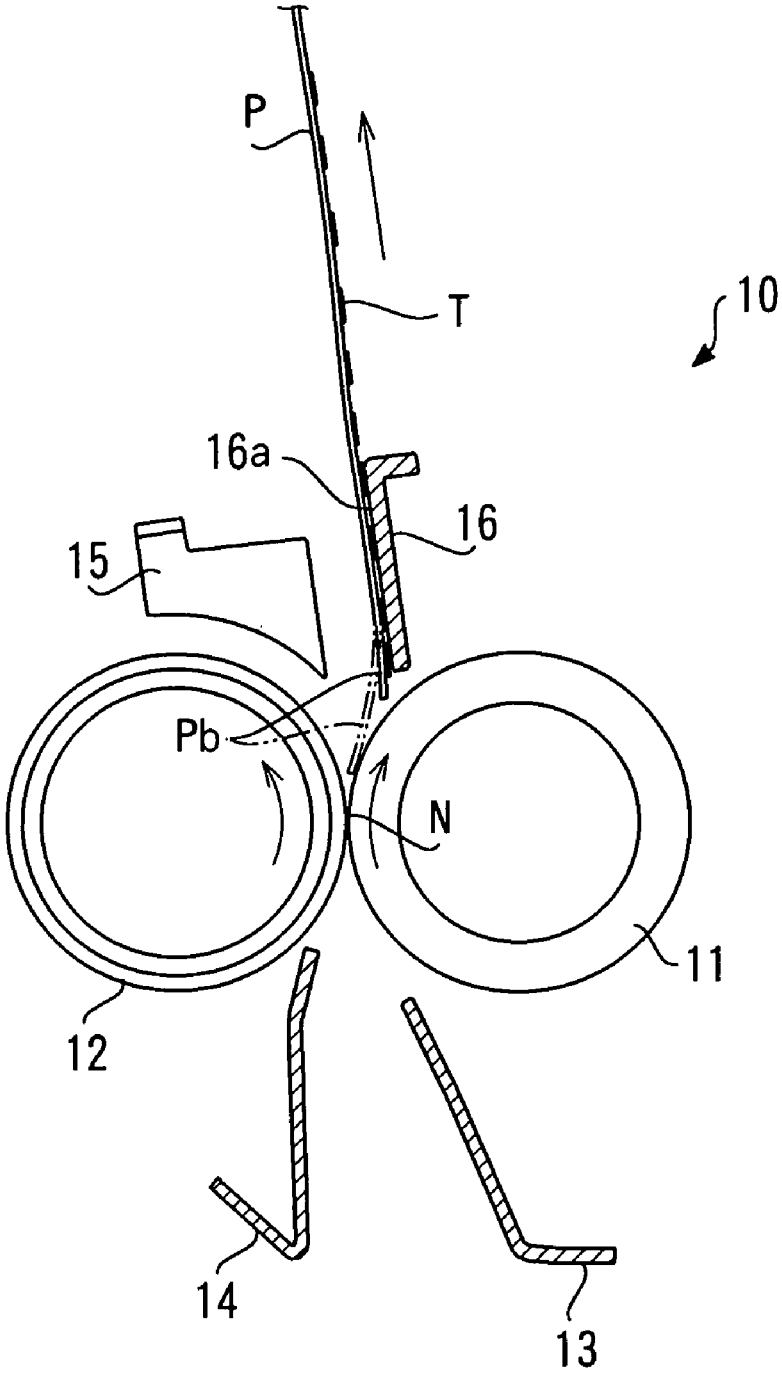
FIG. 3 PRIOR ART
FIG. 3 is a schematic cross-sectional drawing showing the state on completion of separation of a recording medium in a fixing apparatus using a conventional separator.

Embodiments of the present invention will now be described in detail with reference to the accompanying drawings. In the drawings, configuration elements and equivalent parts that have identical configurations or function are assigned the same codes, and descriptions thereof are not repeated.

Embodiment 1

Figure 4:
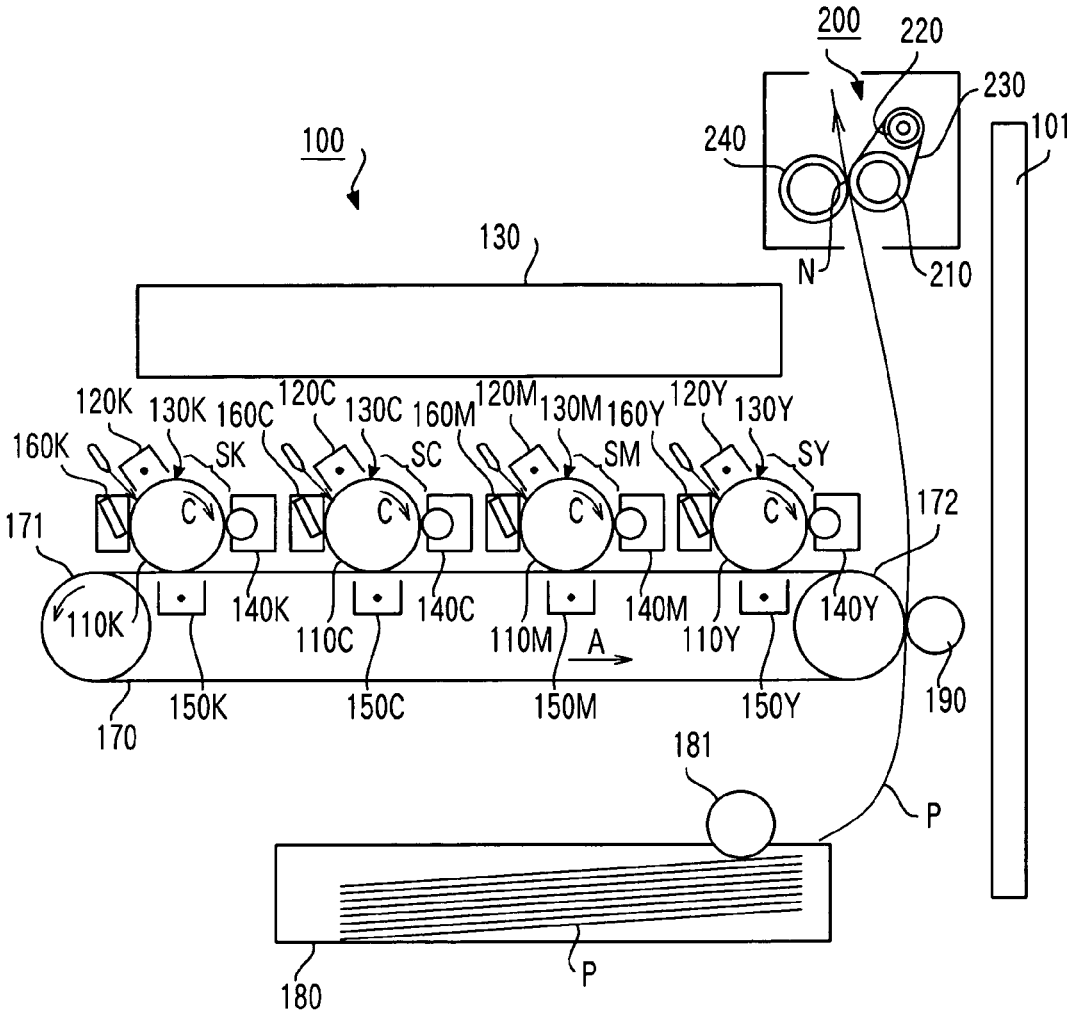
FIG. 4 is a schematic cross-sectional drawing showing the overall configuration of an image forming apparatus suitable for incorporation of a fixing apparatus according to Embodiment 1 of the present invention.

FIG. 4 is a schematic cross-sectional drawing showing the configuration of an image forming apparatus suitable for incorporation of a fixing apparatus according to Embodiment 1 of the present invention. As shown in FIG. 4, this image forming apparatus 100 is a tandem type image forming apparatus that individually forms toner images of four colors contributing to the coloring of a color image on four image bearing elements, successively superimposes these toner images of four colors onto an intermediate transfer element as a primary transfer process, and then performs blanket transfer (secondary transfer) of this primary image to the recording medium.

It goes without saying that a fixing apparatus according to Embodiment 1 is not limited to the above-described tandem type image forming apparatus, and can be installed in all types of image forming apparatus.

In FIG. 4, symbols Y, M, C, and K appended to the reference codes assigned to various configuration elements of image forming apparatus 100 indicate configuration elements involved in formation of a yellow image (Y), magenta image (M), cyan image (C), and black image (K), respectively, with configuration elements assigned the same reference code having a common configuration.

Image forming apparatus 100 has, around photosensitive drums 110Y, 110M, 110C, and 110K functioning as the above-described four image bearing elements, image forming stations SY, SM, SC, and SK, in which are located respectively electrifiers 120Y, 120M, 120C, and 120K, an aligner (exposure apparatus) 130, developing units 140Y, 140M, 140C, and 140K, transfer units 150Y, 150M, 150C, and 150K, cleaning apparatuses 160Y, 160M, 160C, and 160K, and an intermediate transfer belt (intermediate transfer element) 170.

In FIG. 4, each of photosensitive drums 110Y, 110M, 110C, and 110K is rotated in the direction indicated by the arrow, and their respective surfaces are uniformly charged to a predetermined potential by electrifiers 120Y, 120M, 120C, and 120K.

Charged photosensitive drums 110Y, 110M, 110C, and 110K are irradiated with laser beam scanning lines 130Y, 130M, 130C, and 130K corresponding to image data of specific colors by means of aligner 130. By this means, electrostatic latent images of the aforementioned specific colors are formed on the surfaces of photosensitive drums 110Y, 110M, 110C, and 110K.

The electrostatic latent images of each of the specific colors formed on photosensitive drums 110Y, 110M, 110C, and 110K are developed by developing units 140Y, 140M, 140C, and 140K. By this means, unfixed images of the four colors contributing to the coloring of the color image are formed on photosensitive drums 110Y, 110M, 110C, and 110K.

The developed toner images of four colors on photosensitive drums 110Y, 110M, 110C, and 110K undergo primary transfer to above-described endless intermediate transfer belt 170 functioning as an intermediate transfer element by means of transfer units 150Y, 150M, 150C, and 150K. By this means, the toner image of four colors formed on photosensitive drums 110Y, 110M, 110C, and 110K are successively superimposed, and a full-color image is formed on intermediate transfer belt 170.

After the toner images have been transferred to intermediate transfer belt 170, photosensitive drums 110Y, 110M, 110C, and 110K have residual toner remaining on their surfaces removed by cleaning apparatuses 160Y, 160M, 160C, and 160K, respectively.

Here, aligner 130 is installed at a predetermined angle with respect to photosensitive drums 110Y, 110M, 110C, and 110K. Also, intermediate transfer belt 170 is suspended between a drive roller 171 and idler roller 172, and is circulated in the direction indicated by arrow A in FIG. 4 by rotation of drive roller 171.

Meanwhile, at the bottom of image forming apparatus 100, a paper cassette 180 is provided in which recording paper P such as printing paper functioning as a recording medium is held. Recording paper P is fed out from paper cassette 180 by a paper feed roller 181 one sheet at a time into a predetermined sheet path.

When recording paper P fed into this sheet path passes through a transfer nip formed between the outer surface of intermediate transfer belt 170 suspended on idler roller 172 and a secondary transfer roller 190 in contact with the outer surface of intermediate transfer belt 170, the full-color image (unfixed image) formed on intermediate transfer belt 170 is blanket-transferred by secondary transfer roller 190.

Figure 5:
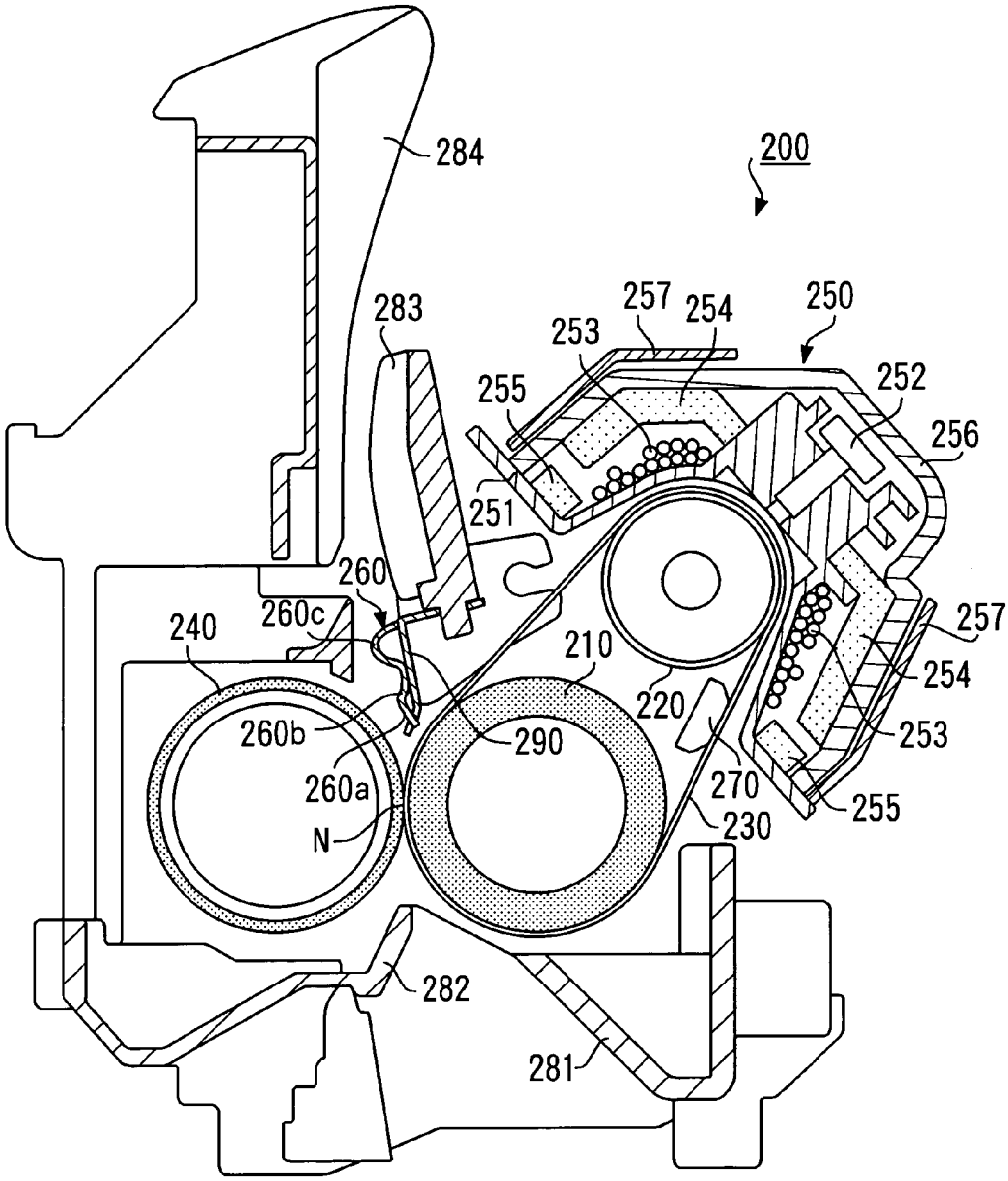
FIG. 5 is a schematic cross-sectional drawing showing the basic configuration of a fixing apparatus according to Embodiment 1 of the present invention.

The unfixed full-color image blanket-transferred to recording paper P is heat-fixed onto recording paper P by passage through fixing nip N formed between the outer surface of a fixing belt 230 suspended between a fixing roller 210 and heating roller 220, and a pressure roller 240 in contact with the outer surface of fixing belt 230, in a fixing apparatus 200 shown in detail in FIG. 5.

Image forming apparatus 100 is equipped with a freely opening and closing door 101 forming part of the housing of image forming apparatus 100, and replacement or maintenance of fixing apparatus 200, handling of recording paper P jammed in the above-described paper transportation path, and so forth, can be carried out by opening and closing this door 101.

Next, fixing apparatus 200 according to Embodiment 1 incorporated in image forming apparatus 100 will be described with reference to FIG. 5.

This fixing apparatus 200 according to Embodiment 1 is an induction heating (IH) type of fixing apparatus, and, as shown in FIG. 5, is equipped with a fixing roller 210, a heating roller 220 as a heating medium, a fixing belt 230 as a heating medium, a pressure roller 240, an induction heating apparatus 250 as a heating section, a separator 260 as a sheet separation guide plate, sheet guide plates 281, 282, 283, and 284 as sheet transportation path forming members, and so forth.

In this fixing apparatus 200, heating roller 220 and fixing belt 230 are heated through the agency of a magnetic field generated by induction heating apparatus 250, and an unfixed image on recording paper P transported along sheet guide plates 281, 282, 283, and 284 is heat-fixed by fixing nip N between heated fixing belt 230 and pressure roller 240.

A fixing apparatus according to the present invention may also be configured so that fixing belt 230 is not used, fixing roller 210 also serves as heating roller 220, and an unfixed image on recording paper P is heat-fixed directly by this fixing roller 210. It also goes without saying that a heat source such as a halogen lamp may also be used as the above-described heating section.

In FIG. 5, heating roller 220 functioning as a heating medium is configured as a rotating element comprising a hollow cylindrical magnetic metallic member of iron, cobalt, nickel, or an alloy of these metals, for example, with both ends supported in rotatable fashion by bearings fixed to supporting side plates (not shown), and rotated by a drive section (not shown). Heating roller 220 has a configuration enabling fast heating with a small amount of heat, with an external diameter of 20 mm and thickness of 0.3 mm, and is regulated so that its Curie point is 300° C. or above.

Fixing roller 210 is configured with, for example, a core of stainless steel or another metal covered by a heat-resistant elastic member of solid or foam silicone rubber, with an outer diameter of about 30 mm, larger than the outer diameter of heating roller 220. The elastic member has a thickness of about 3 to 8 mm and hardness of about 15 to 50° (Asker hardness: 6 to 25° JIS A hardness).

Pressure roller 240 presses against fixing roller 210. Due to the pressure between fixing roller 210 and pressure roller 240, a fixing nip N of predetermined width is formed at the pressure location.

Fixing belt 230 is configured as a heat-resistant belt suspended between heating roller 220 and fixing roller 210. Due to induction heating of heating roller 220 by induction heating apparatus 250 described later herein, the heat of heating roller 220 is transferred at the area of contact between this fixing belt 230 and heating roller 220, and fixing belt 230 is heated all around due to its circulation.

In fixing apparatus 200 configured in this way, the thermal capacity of heating roller 220 is smaller than the thermal capacity of fixing roller 210, and therefore heating roller 220 is heated rapidly, and the warm-up time at the start of heat-fixing is shortened.

Fixing belt 230 is configured, for example, as a heat-resistant belt of multilayered construction, comprising a heating layer with a magnetic metal such as iron, cobalt, nickel, or the like, or an alloy of these metals, as the base material, an elastic layer comprising an elastic component of silicone rubber, fluororubber, or the like, fitted around the surface of this heating layer, and a release layer formed of resin or rubber with good release characteristics, such as PTFE (PolyTetra-Fluoro Ethylene), PFA (Per Fluoro Alkoxy Fluoroplastics), FEP (Fluorinated Ethylene Propylene copolymer), silicone rubber, fluororubber, or the like, alone or mixed.

Even if foreign matter should be introduced between fixing belt 230 and heating roller 220 for some reason, creating a gap, the fixing belt itself can still be heated by induction heating of its heating layer by induction heating apparatus 250. Thus, this fixing belt 230 can itself be heated directly by induction heating apparatus 250, heating efficiency is good, and response is rapid, so that there is little unevenness of temperature and reliability as a heat-fixing section is high.

Pressure roller 240 is configured with an elastic member of high heat resistance and toner releasability fitted to the surface of a core comprising a cylindrical member of a highly heat conductive metal such as copper or aluminum, for example. Apart from the above-mentioned metals, SUS (Steel Use Stainless) may also be used for the core.

This pressure roller 240 forms fixing nip N that grips and transports recording paper P by exerting pressure on fixing roller 210 via fixing belt 230. Here, in fixing apparatus 200 according to Embodiment 1, the hardness of pressure roller 240 is greater than the hardness of fixing roller 210, and fixing nip N is formed by the peripheral surface of pressure roller 240 biting into the peripheral surface of fixing roller 210 via fixing belt 230.

For this reason, pressure roller 240 has an external diameter of about 30 mm, the same as fixing roller 210, a thickness of about 0.52 to 5 mm, thinner than fixing roller 210, and hardness of about 20 to 80° (Asker hardness: 6 to 50° JIS A hardness), harder than fixing roller 210.

In fixing apparatus 200 with this kind of configuration, recording paper P is gripped and transported by fixing nip N so as to follow the surface shape of the peripheral surface of pressure roller 240, with the resultant effect that the heat-fixing surface of recording paper P separates easily from the surface of fixing belt 230.

A temperature detector 270 comprising a thermistor or similar heat-sensitive element with high thermal responsiveness is located in direct contact with the inner peripheral surface of fixing belt 230 in the vicinity of the entry side of fixing nip N. In this fixing apparatus 200, the heating temperature of heating roller 220 and fixing belt 230 is controlled by induction heating apparatus 250 based on the temperature of the inner peripheral surface of fixing belt 230 detected by temperature detector 270 so that the surface temperature of fixing belt 230—that is, the unfixed image heat-fixing temperature—is maintained at a predetermined temperature.

Next, the configuration of induction heating apparatus 250 will be described. As shown in FIG. 5, induction heating apparatus 250 is located so as to face the outer peripheral surface of heating roller 220 via fixing belt 230. Induction heating apparatus 250 is provided with a supporting frame 251 as a coil guide member of fire-resistant resin, curved so as to cover heating roller 220.

In the center part of supporting frame 251, a thermostat 252 is installed so that its temperature detecting part is partially expressed from supporting frame 251 toward heating roller 220 and fixing belt 230. This thermostat 252 detects the temperature of heating roller 220 and fixing belt 230, and if it detects that the temperature of heating roller 220 and fixing belt 230 is abnormally high, forcibly breaks the connection between an exciting coil 253 functioning as a magnetic field generation section wound around the outer peripheral surface of supporting frame 251 and an inverter circuit (not shown).

Exciting coil 253 is configured with a long single exciting coil wire with an insulated surface wound alternately in the axial direction of heating roller 220 along supporting frame 251. The length of the wound part of this exciting coil 253 is set so as to be approximately the same as the length of the area of contact between fixing belt 230 and heating roller 220.

Exciting coil 253 is connected to an inverter circuit (not shown), and generates an alternating field by being supplied with a high-frequency alternating current of 10 kHz to 1 MHz (preferably, 20 kHz to 800 kHz). This alternating field acts upon the heating layers of heating roller 220 and fixing belt 230 in the area of contact between heating roller 220 and fixing belt 230 and its vicinity. Through the agency of this alternating field, an eddy current with a direction preventing variation of the alternating field flows within these heating layers.

This eddy current generates Joule heat corresponding to the resistance of the heating roller 220 and fixing belt 230 heating layers, and causes induction heating of heating roller 220 and fixing belt 230 mainly in the area of contact between heating roller 220 and fixing belt 230 and its vicinity.

On the other hand, in supporting frame 251, an arch core 254 and side core 255 are fitted so as to surround exciting coil 253. Arch core 254 and side core 255 increase the inductance of exciting coil 253 and provide good electromagnetic coupling of exciting coil 253 and heating roller 220. Therefore, in this fixing apparatus 200, it is possible to apply a larger amount of power to heating roller 220 with the same coil current through the agency of arch core 254 and side core 255, enabling the warm-up time to be shortened.

Supporting frame 251 is also provided with a resin housing 256 formed in the shape of a roof so as to cover arch core 254 and thermostat 252 inside induction heating apparatus 250. A plurality of heat release vents are formed in this housing 256, allowing heat generated by supporting frame 251, exciting coil 253, arch core 254, and so forth, to be released externally. Housing 256 may be formed of a material other than resin, such as aluminum, for example.

Supporting frame 251 is also fitted with a short ring 257 that covers the outer surface of housing 256 to prevent blockage of the heat release vents formed in housing 256.

This short ring 257 is located on the rear of arch core 254, and through the generation of an eddy current in the direction in which slight leakage flux leaked externally from the rear of arch core 254 is canceled out, has the effect of generating a magnetic field that cancels out the magnetic field of that leakage flux, and preventing unwanted emission due to that leakage flux.

Next, separator 260 functioning as the above-described sheet separation guide plate, which is the special feature of fixing apparatus 200 according to Embodiment 1, will be described.

Figure 6:
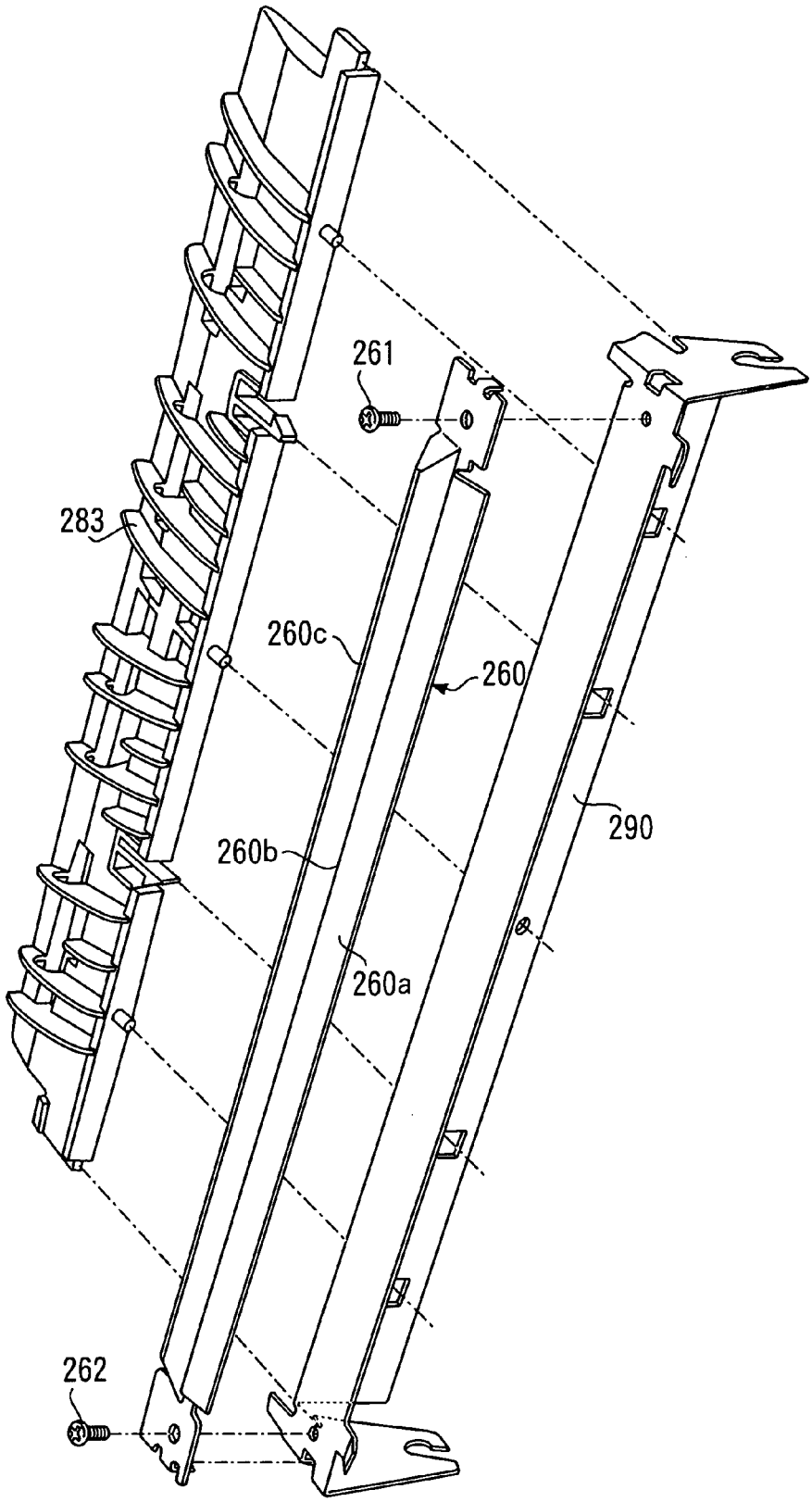
FIG. 6 is an exploded oblique drawing showing the configuration of the separator in a fixing apparatus according to Embodiment 1 of the present invention.

As shown in FIG. 5 and FIG. 6, separator 260 is attached in a removable fashion by means of screws 261 and 262 to a supporting member 290 with an L-shaped cross-section fitted to the main body of fixing apparatus 200. This separator 260 has a guide surface 260*a* for guiding the heat-fixing surface of recording paper P heat-fixed by fixing nip N between fixing belt 230 and pressure roller 240 in a direction in which it separates from fixing belt 230.

Figure 7:
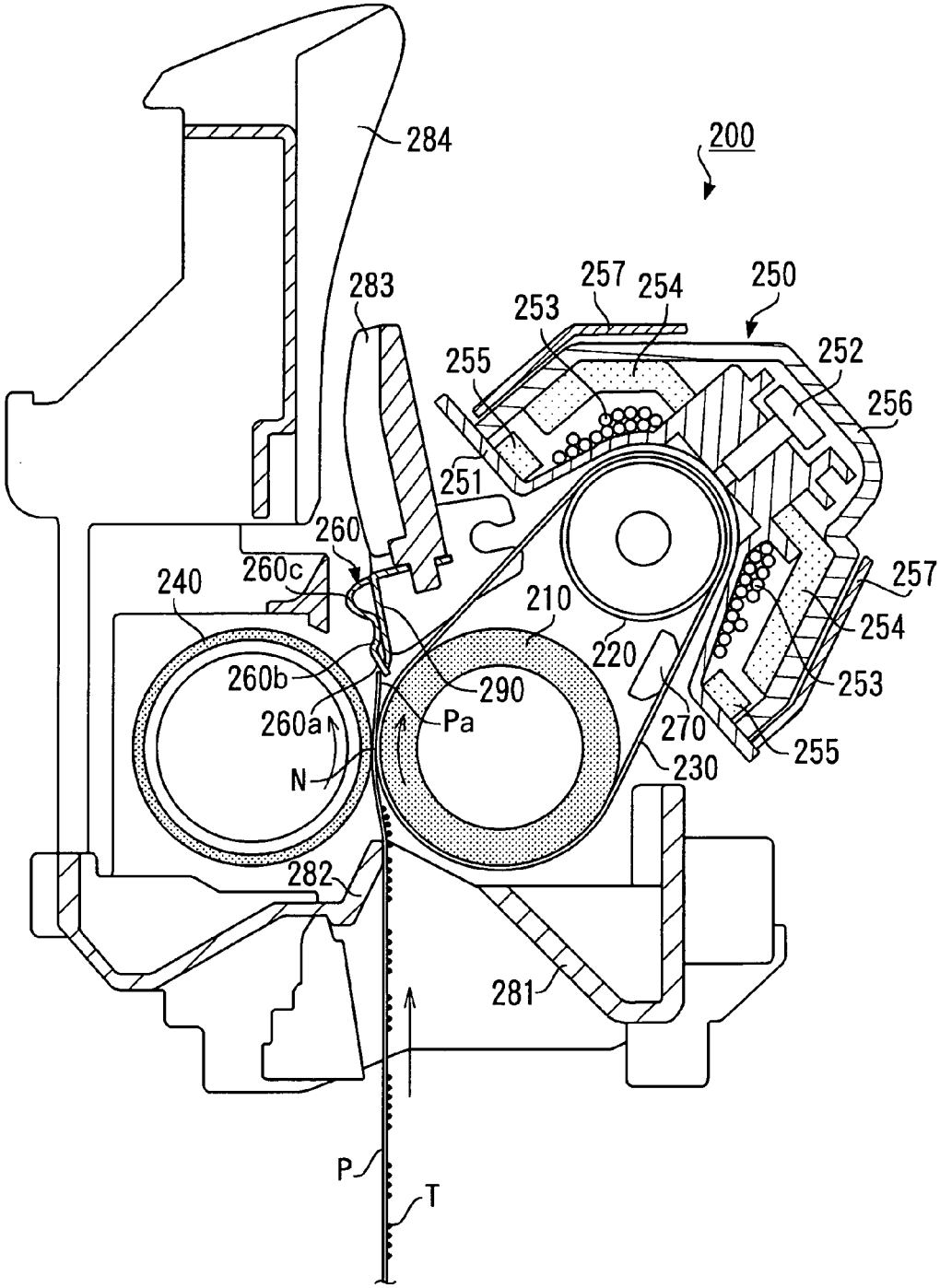
FIG. 7 is a schematic cross-sectional drawing showing the state at the start of separation of a recording medium in a fixing apparatus according to Embodiment 1 of the present invention.
Figure 8:
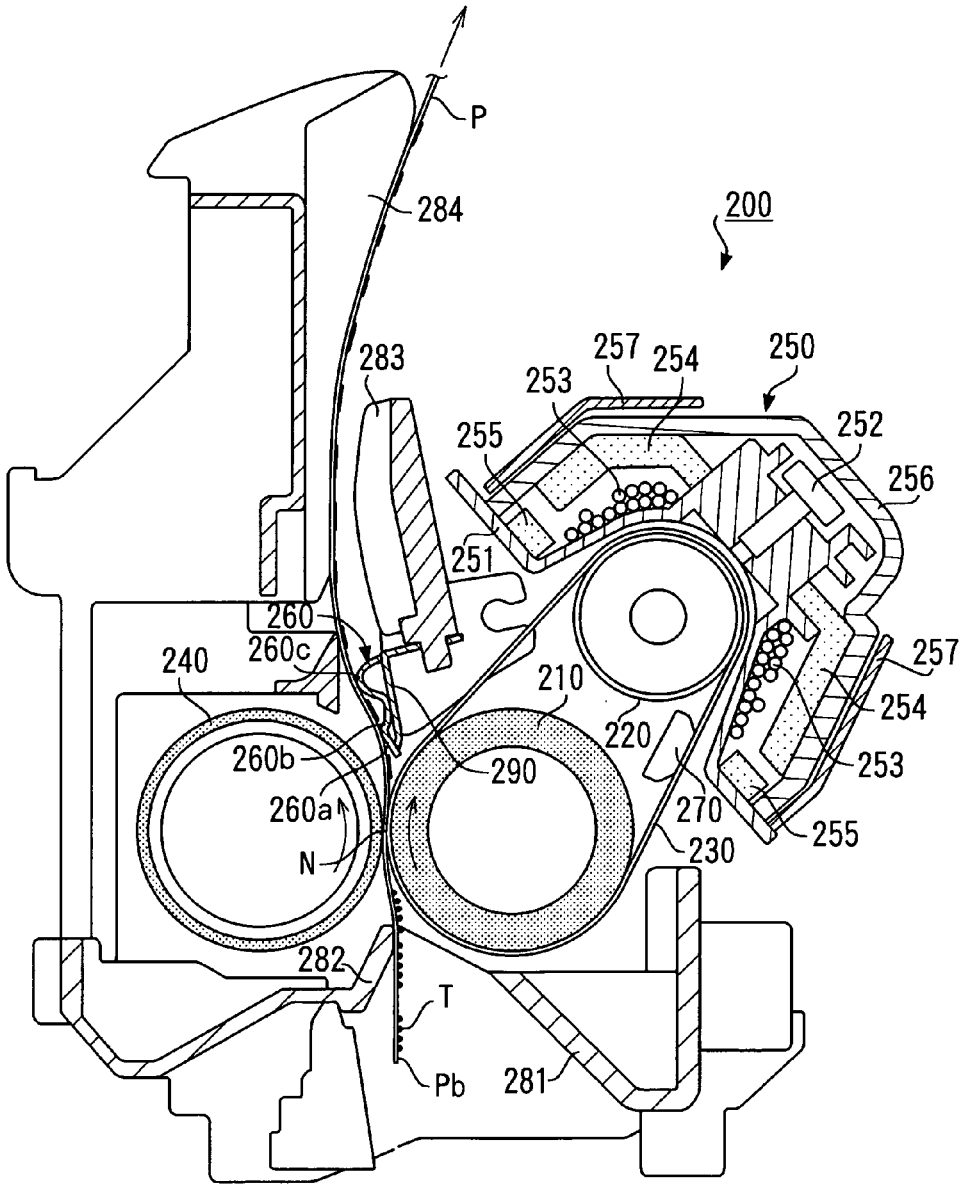
FIG. 8 is a schematic cross-sectional drawing showing the state during separation of a recording medium in a fixing apparatus according to Embodiment 1 of the present invention.

There are provided on guide surface 260*a* of separator 260 two step parts (projecting parts) 260*b* and 260*c* raised along the guide surface 260*a* guide width direction, and a recess 260*d* is formed between step parts 260*b* and 260*c*. As shown in FIG. 7 and FIG. 8, the heights of these two step parts 260*b* and 260*c* are set so that the heat-fixing surface of recording paper P on which an unfixed toner image T has been heat-fixed is guided in the direction of separation from fixing belt 230. That is to say, comparing step part 260*c* located on the guide direction downstream side with step part 260*b* located on the guide direction upstream side, step part 260*c* is located so that its apex is positioned further toward induction heating apparatus 250 constituting the heating section than the positions of fixing belt 230 and pressure roller 240 constituting heating media. FIG. 7 shows the state when the heat-fixing surface of front part Pa of recording paper P starts to separate from fixing belt 230, and FIG. 8 shows the state during transportation after separation of the heat-fixing surface of front part Pa of recording paper P from fixing belt 230, guided by guide surface 260*a* of separator 260.

In FIG. 7, recording paper P is transported toward fixing apparatus 200 after unfixed toner image T has been formed by image forming apparatus 100 as shown in FIG. 4. Recording paper P transported to fixing apparatus 200 passes between the pair of sheet guide plates 281 and 282 positioned at the sheet transportation entrance of fixing apparatus 200, and is transported in the direction indicated by the arrow, gripped by fixing nip N, the area of pressure between fixing belt 230 and pressure roller 240. After recording paper P passes through this fixing nip N, front part Pa of recording paper P is distanced from the surface of fixing belt 230 by the curvature of fixing belt 230 suspended on fixing roller 210.

Then, as shown in FIG. 8, recording paper P is guided so as to come into contact with only the apex parts of step parts 260*b* and 260*c* provided on guide surface 260*a* of separator 260, and is separated from the surface of fixing belt 230. Following this, this recording paper P passes between the pair of sheet guide plates 283 and 284 functioning as sheet transportation path forming members installed at the sheet ejection aperture on the downstream side of separator 260 in the sheet transportation direction, and is ejected from fixing apparatus 200.

Thus, in this fixing apparatus 200, a gap is formed between guide surface 260*a* of separator 260 and the heat-fixing surface of recording paper P guided along guide surface 260*a* by means of step parts 260*b* and 260*c* provided on guide surface 260*a* of separator 260 and recess 260*d* between step parts 260*b* and 260*c*, and the contact area between the heat-fixing surface of recording paper P and guide surface 260*a* decreases. Therefore, in this fixing apparatus 200, it is difficult for the heat-fixing surface of recording paper P to adhere to guide surface 260*a* of separator 260, and recording paper P can be separated smoothly from fixing belt 230 without the occurrence of a sheet jam or image disturbance.

Also, in this fixing apparatus 200, comparing step part 260*c* located on the guide direction downstream side with step part 260*b* located on the guide direction upstream side, step part 260*c* is located so that its apex is positioned further toward induction heating apparatus 250 constituting the heating section than the positions of fixing belt 230 and pressure roller 240 constituting heating media, as a result of which a gap is prone to be formed between guide surface 260*a* and the heat-fixing surface of the rear part of recording paper P guided along guide surface 260*a*, and the contact area between the heat-fixing surface of the rear part of recording paper P and guide surface 260*a* decreases. Therefore, adherence of the heat-fixing surface of the rear part of recording paper P to guide surface 260*a* of separator 260 is not prone to occur, and the rear part of recording paper P can be separated smoothly from fixing belt 230 without the occurrence of a sheet jam or image disturbance.

Embodiment 2

Figure 9:
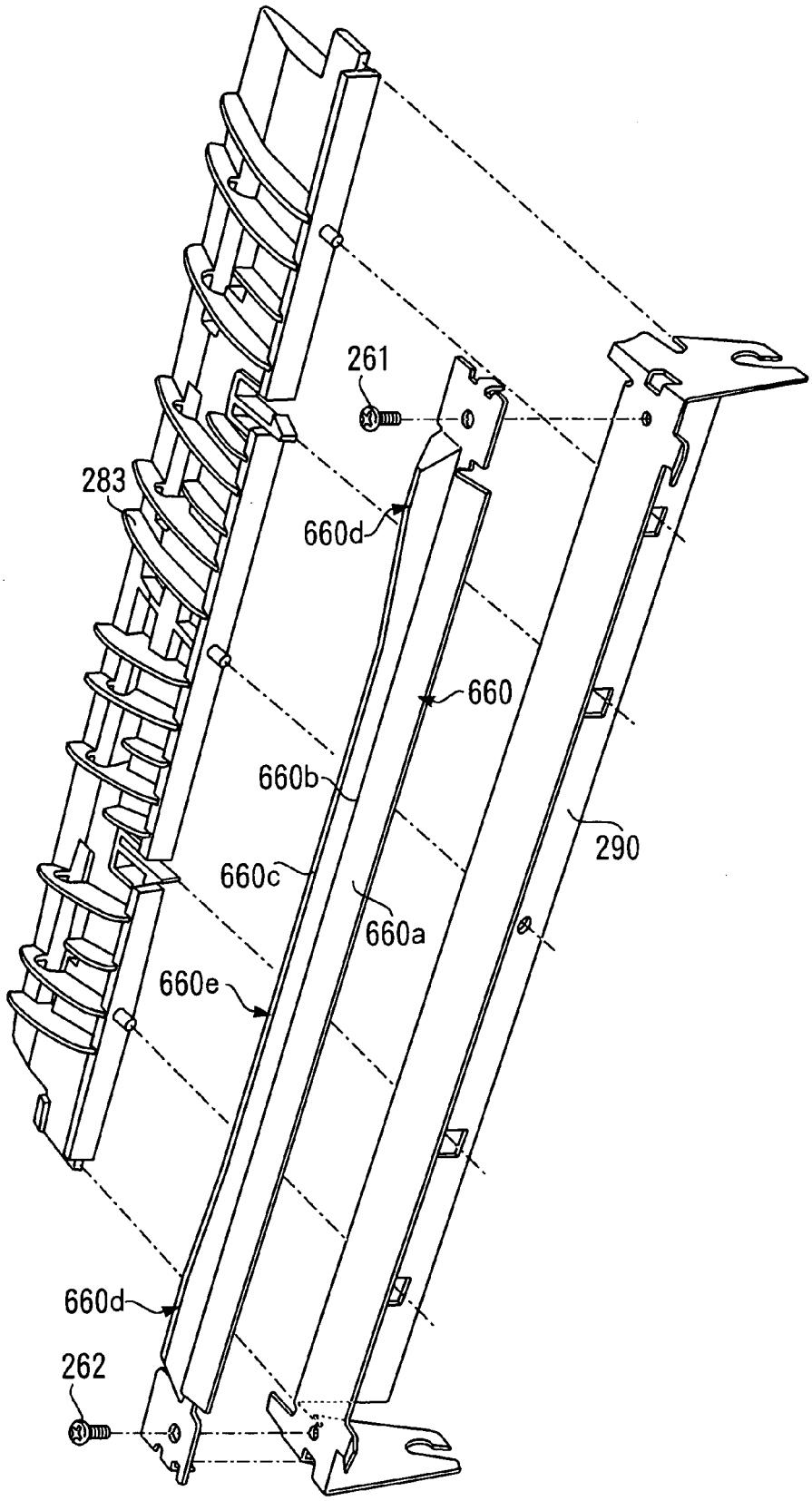
FIG. 9 is an exploded oblique drawing showing the configuration of the separator in a fixing apparatus according to Embodiment 2 of the present invention.

Next, a fixing apparatus according to Embodiment 2 of the present invention will be described. FIG. 9 is an exploded oblique drawing showing the configuration of the separator in a fixing apparatus according to Embodiment 2.

As shown in FIG. 9, this separator 660 is attached to supporting member 290 in a removable fashion by means of screws 261 and 262 in the same way as separator 260 shown in FIG. 6. This separator 660 has a guide surface 660*a* for guiding the heat-fixing surface of recording paper P heat-fixed by fixing nip N between fixing belt 230 and pressure roller 240 in a direction in which it separates from fixing belt 230.

There are provided on guide surface 660*a* of separator 660 two step parts (projecting parts) 660*b* and 660*c* raised along the guide surface 660*a* guide width direction, and a recess 660*e* is formed between step parts 660*b* and 660*c*. The heights of these two step parts 660*b* and 660*c* are set so that the heat-fixing surface of recording paper P on which unfixed toner image T has been heat-fixed is guided in the direction of separation from fixing belt 230. That is to say, comparing step part 660*c* located on the guide direction downstream side with step part 660*b* located on the guide direction upstream side, step part 660*c* is located so that its apex is positioned further toward induction heating apparatus 250 constituting the heating section than the positions of fixing belt 230 and pressure roller 240 constituting heating media shown in FIG. 5.

Figure 10:
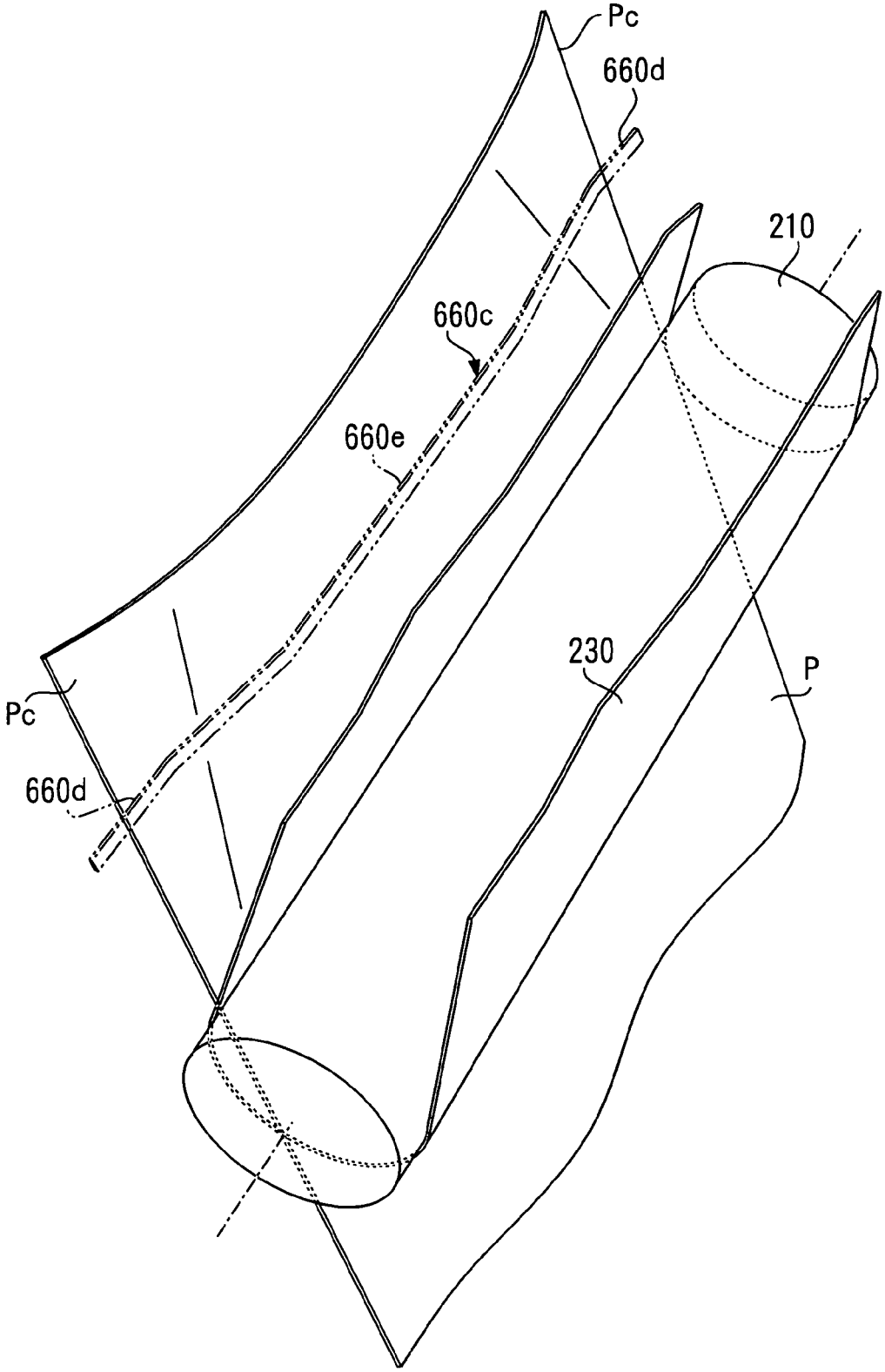
FIG. 10 is a schematic oblique drawing showing the behavior of a recording medium that is separated by the separator in a fixing apparatus according to Embodiment 2 of the present invention.

Incidentally, in this kind of heat-fixing type fixing apparatus, the two sheet width direction sides Pc of the heat-fixing surface of heat-fixed recording paper P shown in FIG. 10 tend to curl in a direction in which they approach fixing belt 230 because of contraction due to heating.

When recording paper P is an OHP sheet, in particular, even if it is separated from the surface of fixing belt 230 without trouble, recording paper P is softened by the heat during heat-fixing of unfixed toner image T, and is consequently transported with a tendency toward adhesion of the two sheet width direction sides Pc of recording paper P to fixing belt 230.

For this reason, in this kind of fixing apparatus, the two sheet width direction sides Pc of recording paper P are heated more than other parts, and there is a tendency for unfixed toner image T at the two sheet width direction sides Pc of recording paper P to melt excessively, causing image disturbance.

Thus, as shown in FIG. 9, separator 660 of a fixing apparatus according to Embodiment 2 is formed so that the heights of the two guide width direction end parts 660*d* of step part 660*c* located on the sheet transportation direction downstream side provided on guide surface 660*a* of separator 660 are greater than the height of guide width direction center part 660*e* of step part 660*c*.

In a fixing apparatus according to Embodiment 2, by having recording paper P guided by guide surface 660*a* of separator 660, the heat-fixing surfaces of the two sheet width direction sides Pc of recording paper P are curved rearward due to the difference in height between the two guide width direction end parts 660*d* and guide width direction center part 660*e* of step part 660*c*, as shown in FIG. 10.

In a fixing apparatus according to Embodiment 2, since the heat-fixing surfaces of the two sheet width direction sides Pc of recording paper P are curved rearward as shown in FIG. 10, the two sheet width direction sides Pc of recording paper P are easily separated from fixing belt 230, enabling the kind of image disturbance described above to be prevented.

Embodiment 3

Figure 11:
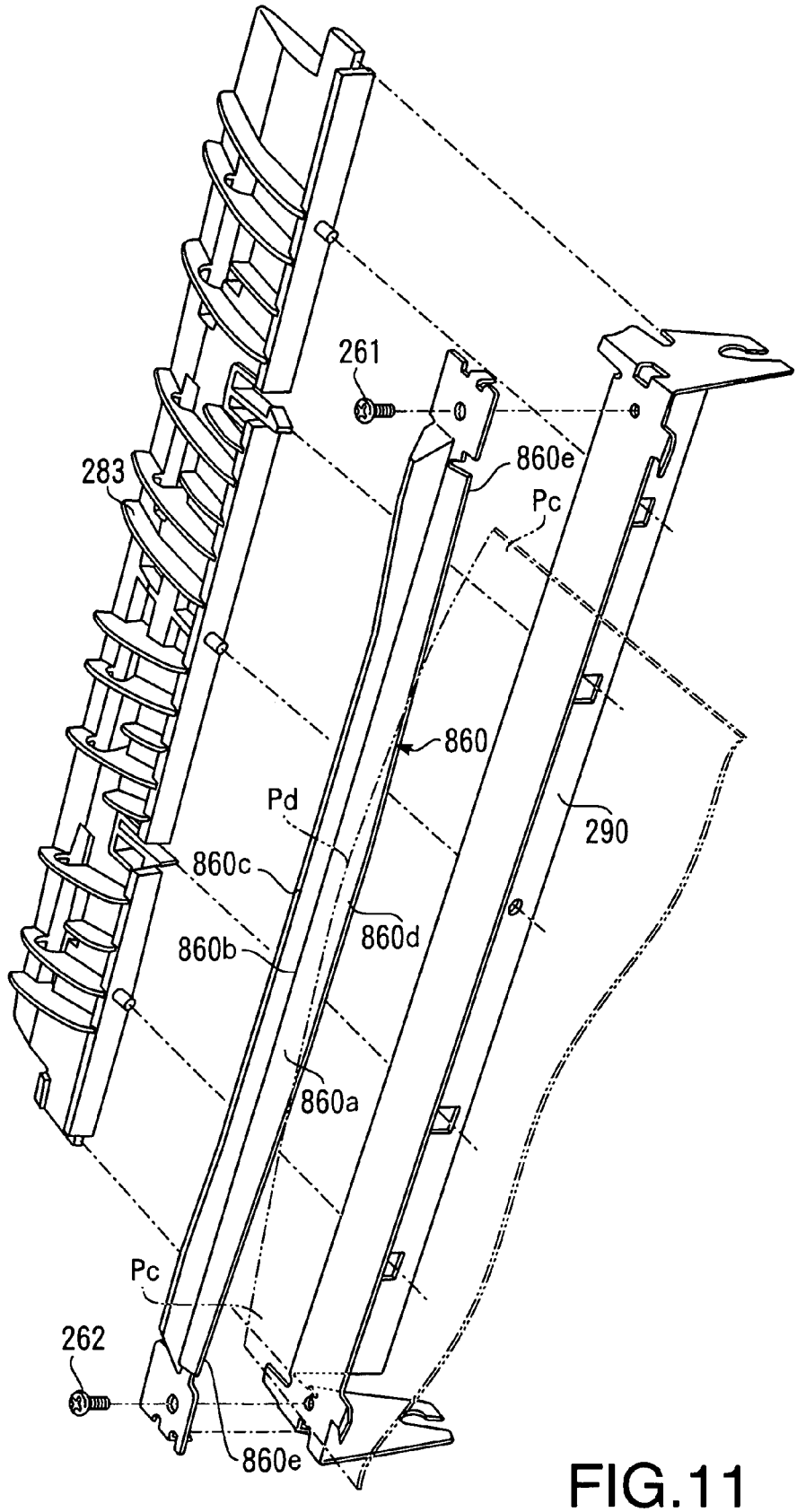
FIG. 11 is an exploded oblique drawing showing the configuration of the separator in a fixing apparatus according to Embodiment 3 of the present invention.

Next, a fixing apparatus according to Embodiment 3 of the present invention will be described. FIG. 11 is an exploded oblique drawing showing the configuration of the separator in a fixing apparatus according to Embodiment 3.

As shown in FIG. 11, this separator 860 is attached to supporting member 290 in a removable fashion by means of screws 261 and 262 in the same way as separator 260 shown in FIG. 6. This separator 860 has a guide surface 860*a* for guiding the heat-fixing surface of recording paper P heat-fixed by fixing nip N between fixing belt 230 and pressure roller 240 in a direction in which it separates from fixing belt 230.

There are provided on guide surface 860*a* of separator 860 two step parts 860*b* and 860*c* raised along the guide surface 860*a* guide width direction, and a recess 860*f* is formed between step parts 860*b* and 860*c*. The heights of these two step parts 860*b* and 860*c* are set so that the heat-fixing surface of recording paper P on which unfixed toner image T has been heat-fixed is guided in the direction of separation from fixing belt 230. That is to say, comparing step part 860*c* located on the guide direction downstream side with step part 860*b* located on the guiding direction upstream side, step part 860*c* is located so that its apex is positioned further toward induction heating apparatus 250 constituting the heating section than the positions of fixing belt 230 and pressure roller 240 constituting heating media shown in FIG. 5.

As described above, in this kind of heat-fixing type fixing apparatus, the two sheet width direction sides Pc of recording paper P tend to curl in a direction in which they approach fixing belt 230 because of contraction due to heating of the heat-fixing surface. Consequently, in this kind of heat-fixing type fixing apparatus, there is a danger of the two sheet width direction sides Pc of recording paper P curled as described above hitting the upstream edge of guide surface 860*a* of separator 860, causing a sheet jam.

Thus, separator 860 in a fixing apparatus according to Embodiment 3 is formed so that guide width direction center edge 860*d* opposite fixing belt 230 projects toward the sheet transportation direction upstream side more than the two guide width direction end parts 860*e* of guide surface 860*a*.

In this fixing apparatus, as shown in FIG. 11, the heat-fixing surface of sheet transportation direction center part Pd of recording paper P is guided dependably further forward than the heat-fixing surface of the two sheet width direction sides Pc of recording paper P by guide width direction center edge 860*d* of guide surface 860*a* of separator 860.

Therefore, in this fixing apparatus according to Embodiment 3, even if the two sheet width direction sides Pc of recording paper P curl, the two sheet width direction sides Pc can be guided dependably so as to follow guide surface 860*a* of separator 860 without causing a sheet jam.

It is desirable for separators 260, 660, and 860 in the fixing apparatuses of the respective embodiments of the present invention to be metal plates. That is to say, separators 260, 660, and 860 configured as metal plates have better heat resistance than when configured as resin plates, making it possible to eliminate problems with recording paper P separation due to thermal deformation of these separators.

Moreover, separators 260, 660, and 860 configured as metal plates can be manufactured at low cost, and also, as their mechanical bending strength in the guide width direction (lengthwise direction) is increased by step parts 260*b* and 260*c*, 660*b* and 660*c*, and 860*b* and 860*c*, assembly position precision can be improved.

Furthermore, it is desirable for these separators 260, 660, and 860 to be configured with respective guide surfaces 260*a*, 660*a*, and 860*a* covered with a low-friction material. That is to say, with separators 260, 660, and 860 whose guide surfaces 260*a*, 660*a*, and 860*a* are covered with a low-friction material, adhesion of recording paper P to respective guide surfaces 260*a*, 660*a*, and 860*a* becomes less prone to occur because the adhesive force of the heat-fixing surface of recording paper P toward guide surfaces 260*a*, 660*a*, and 860*a* decreases.

Figure 12:
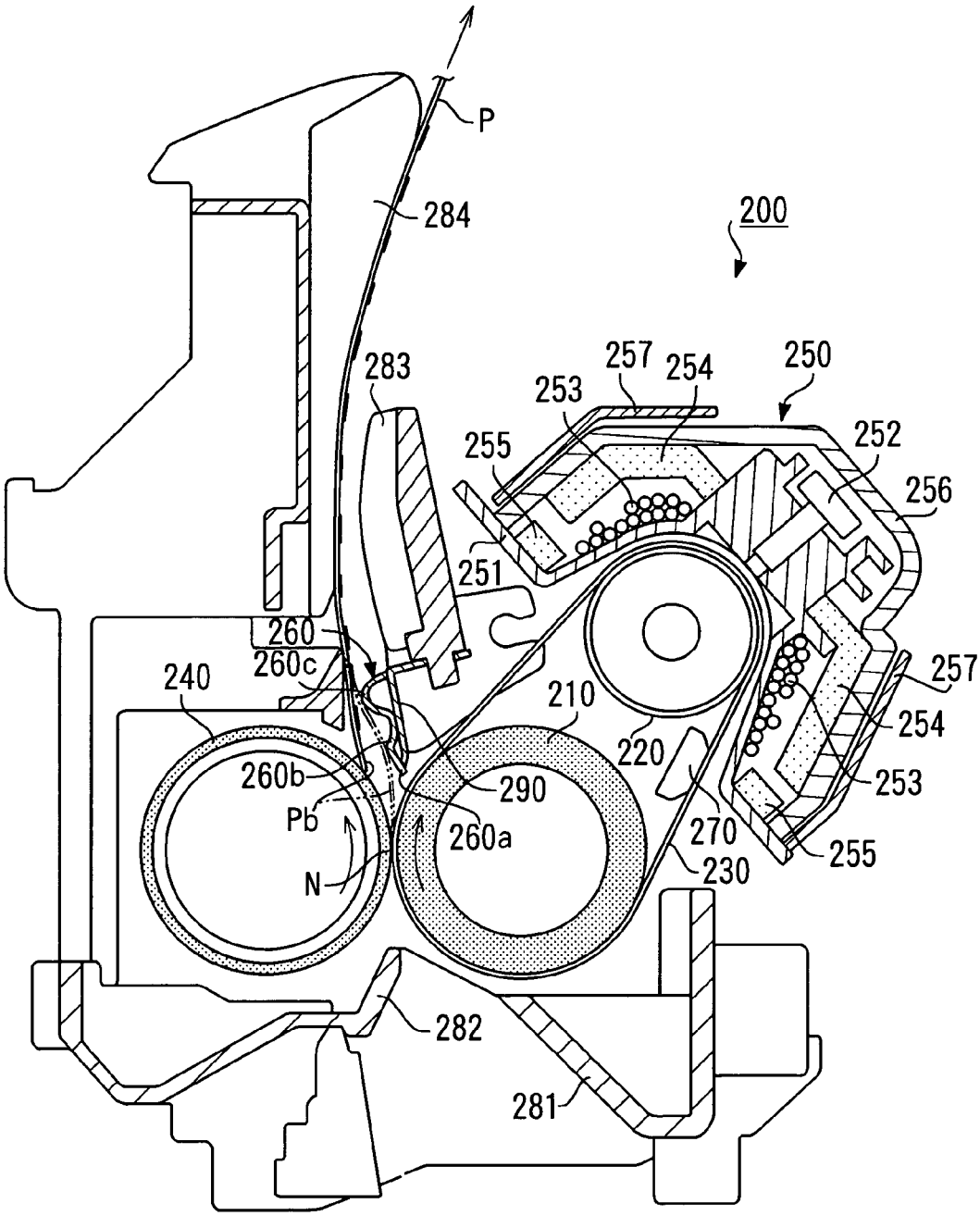
FIG. 12 is a schematic cross-sectional drawing showing the state on completion of separation of a recording medium in a fixing apparatus according to Embodiment 1 of the present invention.

Meanwhile, as shown in FIG. 12, fixing apparatus 200 according to Embodiment 1 is configured so that sheet guide plate 284 functioning as a sheet transportation path forming member located on the sheet transportation direction downstream side of separator 260 causes recording paper P separated from fixing belt 230 and guided by guide surface 260*a* of separator 260 to curve toward the heat-fixing surface side.

In this fixing apparatus 200, as shown in FIG. 12, recording paper P separated from fixing belt 230 and guided by guide surface 260*a* of separator 260 is curved toward the image-fixing surface side by sheet guide plate 284. As a result, recording paper P curved toward the image-fixing surface side tends to recover its state prior to curving due to the force of its stiffness, and force is created in the upstream part of recording paper P that tends toward separation from guide surface 260*a* of separator 260.

Therefore, in fixing apparatus 200 according to Embodiment 1, adhesive force of the heat-fixing surface of recording paper P toward guide surface 260*a* of separator 260 is further decreased, and adhesion of the heat-fixing surface of recording paper P to guide surface 260*a* becomes less prone to occur.

In above-described Embodiment 1 through Embodiment 3, a case has been illustrated in which two step parts (projecting parts) 260*b* and 260*c*, 660*b* and 660*c*, or 860*b* and 860*c* are provided on guide surface 260*a*, 660*a*, or 860*a* of separator 260, 660, or 860 raised along the guide width direction of the guide surface, but three or more step parts may also be provided. As a result of providing more step parts, the contact area between the heat-fixing surface of recording paper and the guide surface is reduced, the heat-fixing surface of recording paper becomes less prone to adhere to the guide surface of the separator, and recording paper can be separated smoothly from the fixing belt without causing a sheet jam or image disturbance.

A first aspect of a fixing apparatus of the present invention has a configuration equipped with a heating medium that heat-fixes an unfixed image onto a recording medium, a heating section that heats the heating medium, and a sheet separation guide plate having a guide surface that guides the heat-fixing surface of the recording medium, on which the unfixed image has been heat-fixed and that is transported along a predetermined sheet path, in the direction of separation from the heating medium; wherein there is provided on the guide surface of the sheet separation guide plate a step part raised along the guide width direction of the guide surface.

According to this configuration, by means of the step part provided on the guide surface of the sheet separation guide plate, a gap is formed between the heat-fixing surface of the recording medium guided along the guide surface and that guide surface, and the contact area between the heat-fixing surface of the recording medium and the guide surface decreases. Therefore, with this configuration, the heat-fixing surface of the recording medium is not prone to adhere to the guide surface of the sheet separation guide plate, and the recording medium can be separated smoothly from the heating medium without causing a sheet jam or image disturbance.

A second aspect of a fixing apparatus of the present invention has a configuration in which, in the fixing apparatus described in the above first aspect, the step part comprises a plurality of projecting parts provided in the sheet guide width direction and a recess formed between the projecting parts.

According to this configuration, by configuring the step part from a plurality of projecting parts and a recess formed between those projecting parts, a gap is formed between the heat-fixing surface of the recording medium guided along the guide surface and that guide surface, and the contact area between the heat-fixing surface of the recording medium and the guide surface decreases. Therefore, with this configuration, the heat-fixing surface of the recording medium is not prone to adhere to the guide surface of the sheet separation guide plate, and the recording medium can be separated smoothly from the heating medium without causing a sheet jam or image disturbance.

A third aspect of a fixing apparatus of the present invention has a configuration in which, in the fixing apparatus described in the above second aspect, comparing the projecting part located on the sheet guide width direction downstream side with the projecting part located on the sheet guide width direction upstream side, the projecting part located on the sheet guide width direction downstream side is located so that its apex is positioned further toward the heating section than the peripheral surface of the heating medium.

According to this configuration, by setting the apex of the projecting part located on the sheet guide width direction downstream side so as to be positioned further toward the heating section than the peripheral surface of the heating medium as compared with the projecting part located on the upstream side, a gap is prone to be formed between the heat-fixing surface of the rear part of the recording medium guided along the guide surface and that guide surface, and the contact area between the rear part heat-fixing surface of the recording medium and the guide surface decreases. Therefore, with this configuration, adherence of the heat-fixing surface of the rear part of the recording medium to the guide surface of the sheet separation guide plate becomes less prone to occur, and the rear part of the recording medium can be separated smoothly from the heating medium without causing a sheet jam or image disturbance.

A fourth aspect of a fixing apparatus of the present invention has a configuration in which, in the fixing apparatus described in the above first aspect, there is provided a sheet transportation path forming member on the sheet transportation direction downstream side of the sheet separation guide plate that causes the recording medium separated from the heating medium and guided by the guide surface of the sheet separation guide plate to curve toward the heat-fixing surface side.

According to this configuration, in addition to attaining the effect of the fixing apparatus described in the first aspect, the recording medium separated from the heating medium and guided by the guide surface of the sheet separation guide plate is curved toward the image-fixing surface side by the sheet transportation path forming member. As a result, the recording medium curved toward the image-fixing surface side tends to recover its state prior to curving due to the force of its stiffness, and force is created in the upstream part of the recording medium that tends toward separation from the guide surface of the sheet separation guide plate. Therefore, with this configuration, adhesive force of the heat-fixing surface of the recording medium toward the guide surface of the sheet separation guide plate is further decreased, and adhesion of the heat-fixing surface of the recording medium to the guide surface becomes less prone to occur.

A fifth aspect of a fixing apparatus of the present invention has a configuration in which, in the fixing apparatus described in the above first aspect, the heights of the two guide width direction end parts of the step part provided on the guide surface of the sheet separation guide plate are made greater than the height of the guide width direction center part of the step part.

According to this configuration, in addition to attaining the effect of the fixing apparatus described in the first aspect, by having the recording medium guided by the guide surface of the sheet separation guide plate, the heat-fixing surfaces of the two sheet width direction sides of the recording medium are curved rearward due to the difference in height between the two guide width direction end parts and guide width direction center part provided on the guide surface. By causing the heat-fixing surfaces of the two sheet width direction sides of the recording medium to curve rearward in this way, image disturbance of the two sheet width direction sides of the recording medium can be prevented. That is to say, in this kind of fixing apparatus, the two sheet width direction sides of the heat-fixing surfaces of a heat-fixed recording medium tend to curl in a direction in which they approach the heating medium because of contraction due to heating. When the recording medium is an OHP sheet, in particular, even if it is separated from the surface of the heating medium without trouble, the recording medium is softened by the heat during heat-fixing of an unfixed image, and is consequently transported with a tendency toward adhesion of the two sheet width direction sides of the recording medium to the heating medium. For this reason, in this kind of fixing apparatus, the two sheet width direction sides of the recording medium are heated more than other parts, and there is a tendency for an unfixed image at the two sheet width direction sides of the recording medium to melt excessively, causing image disturbance. With this configuration, since the heat-fixing surfaces of the two sheet width direction sides of the recording medium are curved rearward, the two sheet width direction sides of the recording medium are easily separated from the heating medium, enabling the above-described image disturbance to be prevented.

A sixth aspect of a fixing apparatus of the present invention has a configuration in which, in the fixing apparatus described in the above first aspect, the guide width direction center edge opposite the heating medium of the guide surface of the sheet separation guide plate is formed so as to project toward the sheet transportation direction upstream side more than the two guide width direction end parts of the guide surface.

According to this configuration, in addition to attaining the effect of the fixing apparatus described in the first aspect, the heat-fixing surface of the sheet transportation direction center part of the recording medium is guided dependably further forward than the heat-fixing surface of the two sheet width direction sides of the recording medium by the guide width direction center edge of the guide surface of the sheet separation guide plate. That is to say, in this kind of heat-fixing type fixing apparatus, the two sheet width direction sides of the recording medium tend to curl in a direction in which they approach the heating medium because of contraction due to heating of the heat-fixing surface, and consequently, in this kind of fixing apparatus, there is a danger of the two sheet width direction sides of the recording medium curled as described above hitting the upstream edge of the guide surface of the sheet separation guide plate, causing a sheet jam. According to this configuration, the heat-fixing surface of the sheet transportation direction center part of the recording medium can be guided dependably by the guide width direction center edge of the guide surface of the sheet separation guide plate projecting toward the sheet transportation direction upstream side of the recording medium. Therefore, with this configuration, even if the two sheet width direction sides of the recording medium curl, the two sheet width direction sides can be guided dependably so as to follow guide surface without causing a sheet jam.

A seventh aspect of a fixing apparatus of the present invention has a configuration in which, in the fixing apparatus described in the above first aspect, the guide surface of the sheet separation guide plate is covered with low-friction material.

According to this configuration, in addition to attaining the effect of the fixing apparatus described in the first aspect, adhesion of the recording medium to the guide surface of the sheet separation guide plate becomes less prone to occur because the adhesive force of the heat-fixing surface of the recording medium toward the guide surface of the sheet separation guide plate decreases.

An eighth aspect of a fixing apparatus of the present invention has a configuration in which, in the fixing apparatus described in the above first aspect, the sheet separation guide plate is a metal plate.

According to this configuration, in addition to attaining the effect of the fixing apparatus described in the first aspect, the sheet separation guide plate has better heat resistance than when configured as a resin plate, making it possible to eliminate problems with recording medium separation due to thermal deformation of the sheet separation guide plate. Also, with this configuration, the sheet separation guide plate can be manufactured at low cost, and mechanical bending strength in the guide width direction (lengthwise direction) of the sheet separation guide plate is increased by the step part, enabling assembly position precision of the sheet separation guide plate to be improved. Heat resistance and assembly position precision of the sheet separation guide plate are extremely important in influencing the separability of the recording medium in a fixing apparatus.

A ninth aspect of an image forming apparatus of the present invention has a configuration equipped with an image forming section that forms an unfixed image on a recording medium, and a fixing section that heat-fixes an unfixed image formed on the recording medium by the image forming section by means of a heated heating medium; wherein a fixing apparatus described in the above first aspect is used as the fixing section.

According to this configuration, the recording medium on which the unfixed image has been heat-fixed by the heating medium can be separated smoothly from the heating medium without causing a sheet jam or image disturbance, enabling high-image-quality printing to be achieved efficiently.

The present application is based on Japanese Patent Application No. 2004-016168 filed on Jan. 23, 2004, the entire content of which is expressly incorporated by reference herein.

INDUSTRIAL APPLICABILITY

The present invention makes it possible for a recording medium to be separated smoothly from a heating medium without causing a sheet jam or image disturbance after heat-fixing by a fixing apparatus that heat-fixes an unfixed image onto a recording medium, and more particularly by a fixing apparatus used in an image forming apparatus such as an electrophotographic or electrostatographic copier, facsimile machine, or printer.

The invention claimed is:

1. A fixing apparatus comprising:

a heating medium that heat-fixes an unfixed image onto a recording medium;

a heater that heats said heating medium; and a sheet separation guide plate having a guide surface that guides a heat-fixing surface of said recording medium, on which said unfixed image has been heat-fixed and which is transported along a predetermined sheet path, in a direction of separation from said heating medium;

wherein said guide surface of said sheet separation guide plate comprises a step part raised along a guide width direction of said guide surface, wherein said step part comprises a plurality of projecting parts, provided in a guide width direction, and a recess between said projecting parts, and wherein, comparing a downstream projecting part, located on a sheet transportation direction downstream side, with an upstream projecting part located on a sheet transportation direction upstream side, said downstream projecting part is located so that an apex thereof is positioned further toward said heater than a peripheral surface of said heating medium.

2. The fixing apparatus according to claim 1, wherein a sheet transportation path forming member, provided on said sheet transportation direction downstream side of said sheet separation guide plate, causes said recording medium, separated from said heating medium and guided by said guide surface of said sheet separation guide plate, to curve toward said heat-fixing surface side of said recording medium.

3. The fixing apparatus according to claim 1, wherein heights of both guide width direction end portions of said step part provided on said guide surface of said sheet separation guide plate are greater than a height of a guide width direction center portion of said step part.

4. The fixing apparatus according to claim 1, wherein a guide width direction center edge opposite said heating medium of said guide surface of said sheet separation guide plate projects toward the sheet transportation direction upstream side more than both guide width direction end portions of said guide surface.

5. The fixing apparatus according to claim 1, wherein said guide surface of said sheet separation guide plate includes low-friction material.

6. The fixing apparatus according to claim 1, wherein said sheet separation guide plate comprises a metal plate.

7. An image forming apparatus comprising:

an image forming section that forms an unfixed image on a recording medium; and a fixing section that heat-fixes an unfixed image formed on said recording medium by said image forming section by a heated heating medium;

wherein the fixing apparatus according to claim 1 comprises said fixing section.

8. A fixing apparatus comprising:

a heating medium that heat-fixes an unfixed image onto a recording medium;

a heater that heats said heating medium; and a sheet separation guide plate having a guide surface that guides a heat-fixing surface of the recording medium, on which the unfixed image has been heat-fixed and which is transported along a predetermined sheet path, in a direction of separation from the heating medium;

wherein the guide surface of the sheet separation guide plate comprises a step part raised along a guide width direction of the guide surface, and wherein a sheet transportation path forming member, provided on the sheet transportation direction downstream side of the sheet separation guide plate, that causes the recording medium, separated from the heating medium and guided by the guide surface of the sheet separation guide plate, to curve toward the heat-fixing surface side of the recording medium.

9. The fixing apparatus according to claim 8, wherein heights of both guide width direction end portions of the step part provided on the guide surface of the sheet separation guide plate are greater than a height of a guide width direction center portion of the step part.

10. The fixing apparatus according to claim 8, wherein a guide width direction center edge opposite the heating medium of the guide surface of the sheet separation guide plate projects toward a sheet transportation direction upstream side more than both guide width direction end portions of the guide surface.

11. The fixing apparatus according to claim 8, wherein the guide surface of the sheet separation guide plate includes low-friction material.

12. The fixing apparatus according to claim 8, wherein the sheet separation guide plate comprises a metal plate.

13. An image forming apparatus comprising:

an image forming section that forms an unfixed image on a recording medium; and a fixing section that heat-fixes an unfixed image formed on the recording medium by the image forming section by a heated heating medium;

wherein the fixing apparatus according to claim 8 comprises the fixing section.

14. A fixing apparatus comprising:

a heating medium that heat-fixes an unfixed image onto a recording medium;

a heater that heats said heating medium; and a sheet separation guide plate having a guide surface that guides a heat-fixing surface of the recording medium, on which the unfixed image has been heat-fixed and which is transported along a predetermined sheet path, in a direction of separation from the heating medium;

wherein the guide surface of the sheet separation guide plate comprises a step part raised along a guide width direction of the guide surface, and wherein heights of both guide width direction end portions of the step part provided on the guide surface of the sheet separation guide plate are greater than a height of a guide width direction center portion of the step part.

15. The fixing apparatus according to claim 14, wherein a guide width direction center edge opposite the heating medium of the guide surface of the sheet separation guide plate projects toward a sheet transportation direction upstream side more than both guide width direction end portions of the guide surface.

16. The fixing apparatus according to claim 14, wherein the guide surface of the sheet separation guide plate includes low-friction material.

17. The fixing apparatus according to claim 14, wherein the sheet separation guide plate comprises a metal plate.

18. An image forming apparatus comprising:

an image forming section that forms an unfixed image on a recording medium; and a fixing section that heat-fixes an unfixed image formed on the recording medium by the image forming section by a heated heating medium;

wherein the fixing apparatus according to claim 14 comprises the fixing section.

* * * * *